US005131101A

United States Patent [19]

Chin

[11] Patent Number: 5,131,101

[45] Date of Patent: Jul. 21, 1992

[54] AUXILIARY SHIELDING DEVICE FOR SAFETY HELMETS

[76] Inventor: Chen L. S. Chin, No 343, Chung Cheng Rd., Yung Kang Hsiang, Tainan Hsien, Taiwan

[21] Appl. No.: 665,659

[22] Filed: Mar. 7, 1991

[51] Int. Cl.[5] ..... A42B 1/08

[52] U.S. Cl. ..... 2/424; 2/432; 2/434; 2/438

[58] Field of Search ..... 2/422, 424, 425, 432, 2/438, 6, 9, 10, 434

[56] References Cited

U.S. PATENT DOCUMENTS

| | | | |
|---|---|---|---|
| 4,047,249 | 9/1977 | Booth | 2/424 |
| 4,101,980 | 7/1978 | Stephan et al. | 2/424 |
| 4,138,746 | 2/1979 | Bergmann | 2/424 |
| 4,542,538 | 9/1985 | Moretti et al. | 2/438 |

FOREIGN PATENT DOCUMENTS

| | | | |
|---|---|---|---|
| 8200243 | 2/1982 | PCT Int'l Appl. | 2/424 |
| 2052244 | 1/1981 | United Kingdom | 2/424 |

*Primary Examiner*—Werner H. Schroeder
*Assistant Examiner*—Michael A. Neas
*Attorney, Agent, or Firm*—Zarley, McKee, Thomte, Voorhees & Sease

[57] ABSTRACT

An auxiliary shielding device has a visor and an apparatus for mounting the visor to a shield of a safety helmet. The visor is approximately one-half the longitudinal height of the shield and is tinted to provide eye protection from the sun. The apparatus for mounting includes a pair of shield mounts fixed to distal ends of the shield and a pair of visor mounts fixed to distal ends of the visor. Each shield mount has a track formed therein, and each visor mount has a mechanism which links the visor mount with a corresponding shield mount, rendering the visor longitudinally slidable and anchorable across the shield.

8 Claims, 4 Drawing Sheets

AUXILIARY SHIELDING DEVICE FOR SAFETY HELMETS

BACKGROUND OF THE INVENTION

1. Field of the Invention

The present invention relates to shielding devices that are used on safety helmets. More particularly, the present invention provides an auxiliary shielding device for safety helmet shields that is tinted to block out the sun's harmful rays and adjustable to be easily positioned when not in use.

2. Description of Related Art

Safety helmets are worn during any potentially dangerous activity to protect the user's head from the force incurred by a possible strike with a foreign or external object. Apart from the construction field and the military, safety helmets are popularly worn when riding motorcycles, snowmobiles, and other like recreational vehicles. These safety helmets are either full faced or opened faced and generally have a shield which is either integral with or attachable to the helmet. The shield can be either fixed or rotatable with respect to the helmet.

When wearing a safety helmet, it is often desired to protect one's eyes from the sun's harmful rays. The helmet's shield, in and of itself, protects one's eyes from debris thrown up from the road surface or present in the air, such as dust, pebbles, flying insects, tree branches, etc., but does not offer protection from the sun.

To satisfy one's need for eye protection from the sun, sunglasses can be worn, but due to the anatomy of the human head, the close-fitting design of the safety helmet, and the structure of the sunglasses, this is usually not possible without damaging the sunglasses.

To overcome this nuisance, the shields themselves are tinted to offer protection from the sun. This provides the desired protection without the burden of sunglasses. And although this is a widely accepted method, the tinted shield has its own disadvantage: it is not safe for twilight and night conditions.

When riding a motorcycle, for example, as day approaches night, long shadows are cast on the driving surface by streetside buildings and roadside trees, impairing distinct vision through the shield. If the shield is rotatably mounted to the helmet, then the shield can be pivoted to allow clear vision. But by doing this, the unprotected eyes of the user are subjected to dust, and other air-borne particles, and mosquitoes, and other flying insects, as well as the sun's rays, either direct or reflected. The danger of a tinted shield is obvious for nighttime use, especially if the shield is a non-rotatable type.

Similar disadvantages apply to the use of the safety helmet with a tinted shield when operating a snowmobile. Eye protection is particularly desired during this activity since the reflection from the snow is as much as a hazard as direct rays from the sun. Goggles often substitute for sunglasses in this case and have the same drawbacks. If the goggles are placed around the helmet onto the shield itself, then there is the possibility of them being easily dislodged and lost. As to the condition previously described, the same hazards exist, with the exception of dust and insects, but with the addition of tree branches, as snowmobiles are often rode through wooded areas. And more of a hazard than this when the shield is pivoted, leaving unprotected eyes, is wind-chill factor. The speed of the snowmobile coupled with the temperature produces a extremely hazardous and unbearable windchill factor.

In addition to the above situations, the subdued light inherent during rainy, snowy, or overcast conditions also poses a visibility problem for the user with a safety helmet with a tinted shield.

It is clear that there has been a long and unfulfilled need in the related art for an auxiliary shielding device to provide a safety helmet user protection from the sun when desired, and safe, unhindered vision at all other times.

SUMMARY OF THE INVENTION

The present invention provides an auxiliary shielding device adapted to be mounted to any conventional shield of a safety helmet, comprising a visor made out of a flexible and pliant material, such as plexi-glass, so as to conform with the curvature of the shield, and tinted so as to provide protection from the sun, and being approximately one-half the longitudinal height of the shield so as to allow a user vision only through the shield when the visor is not desired; a pair of shield mounts each with a track formed therein to be fixed to distal ends of the shield: and a pair of mounting means, each including a visor mount with a recess and a pair of slots formed therein to be fixed to opposite ends of the visor; a track link with a pair of blocks and a peg positioned at an inner end thereof to be received by the recess of the visor mount, and with a hooked outer end to be received by the track of the shield mount; and a spring means for providing tension with a coil to be fitted over the peg of the track link, and with a pair of ends having a 90° bend to be received by the pair of slots of the visor mount.

In order to provide safety helmets with eye protection from the sun, overcoming the drawbacks of sunglasses and shield tinting, the present invention comprehends an auxiliary shielding device that, once assembled and mounted to a shield of a safety helmet, can slide in a longitudinal direction across an outside surface of the shield, from a top portion thereof to a bottom portion thereof. Being that the visor of the shielding device is about one-half of the longitudinal height of the shield, when the visor is positioned across the top portion, it provides protection for the user's eyes from the sun, and when the visor is positioned across the bottom portion, it allows the user normal vision through the shield alone.

There are several preferred embodiments of the present invention, each providing slight modifications of the elements of the shielding device in a different possible combination. These embodiments concern the various possibilities of longitudinally adjusting the shielding device and of mounting or engaging the track link and hooked outer end thereof into the shield mount and track thereof.

DESCRIPTION OF THE PREFERRED EMBODIMENTS

Figure 1:
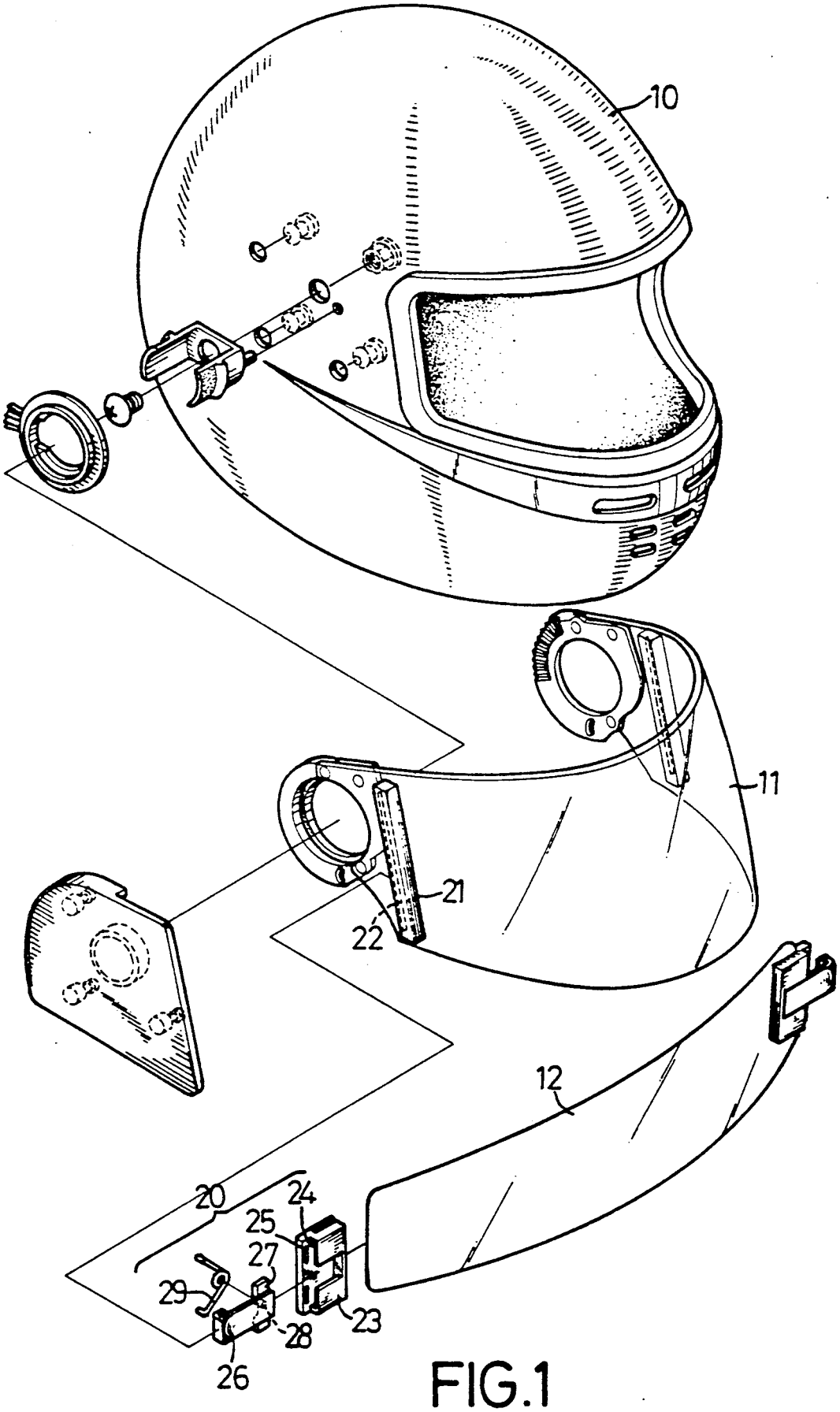
FIG. 1 is an exploded view of an auxiliary shielding device according to a preferred embodiment of the present invention, shown in relation to a conventional safety helmet, shield, and attaching means.

Referring to the drawings, particularly to FIG. 1, a conventional safety helmet 10 is shown with a known shield 11 mounted thereto by a previously disclosed attachment means which allow the shield 11 to be rotated if desired. It should be known that the shield 11 could be of the type integral with the helmet 10, not employing any attachment means, either sophisticated or simple.

An auxiliary visor 12 is disposed on the shield 11 by a pair of mounting means 20 and a pair of shield mounts 21. The visor 12 should be made out of a resilient, transparent material, such as a petrol-chemical product like plexi-glass, so as to be flexible and pliant, molding the curvature of the shield 11. The visor 12 should also have a longitudinal height approximately one-half of that of the shield 11 so as to completely wrap around thereof. Finally, the visor 12 should be tinted or treated in order to provide protection from the sun's glare or harmful ultraviolet rays. The shield mount 21 are fixedly mounted to the shield 11 by ultrasonic welding or fastening means such as a suitable adhesive or screws (not shown).

Figure 4:
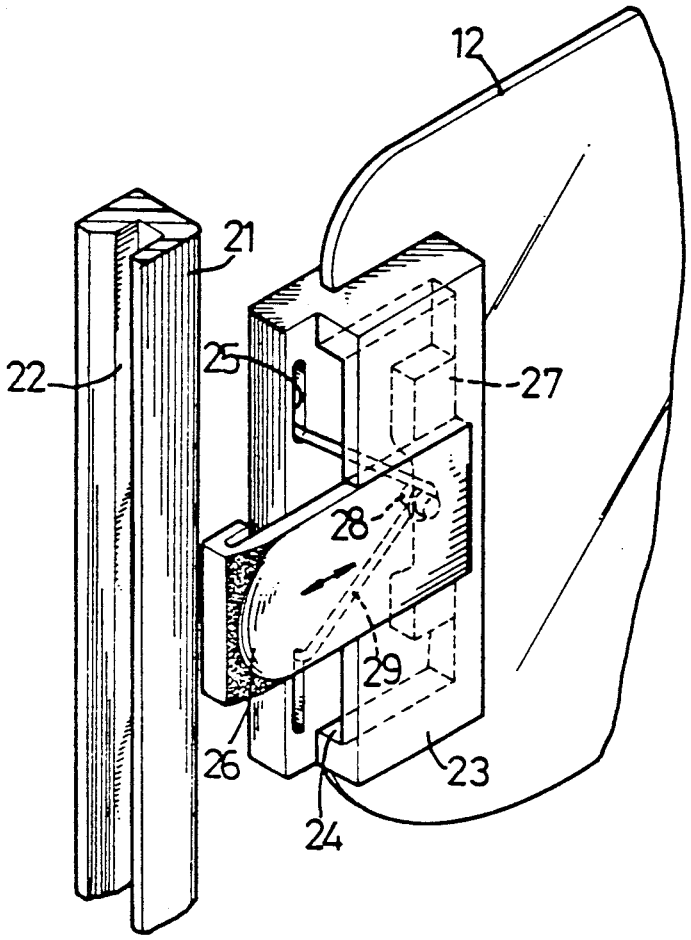
FIG. 4 is a perspective view of a mounting means and a shield mount of the auxiliary shielding device according to another preferred embodiment of the present invention.

Still referring to FIG. 1, the mounting means 20 consist of a pair of identical apparatuses placed at distal ends of the shield 11 and of the visor 12. For the grammatical ease of discussion, the mounting means 20 will be described in singular terms, with appropriate additional reference to FIG. 4, as will be the pair of shield mounts 21.

The shield mount 21 is substantially rectangular and has a rectilinear track 22 disposed therein. The track 22 could cut through the entire longitudinal length of the shield mount 21 and could be set slightly off-center so that a first wall of the shield mount 21 would have a width less than that of a second wall of the shield mount 21, causing the shield mount 21 to be longitudinally asymmetrical. Also, the second wall of the shield mount 21 could have a beveled inside edge, i.e., an edge in common with the track 22, as all shown in FIG. 4, and which will be discussed later.

The shield mount 21 is fixed to an outside surface of the shield 11, proximate to the location of the attachment means, with an outside surface of the second wall of the shield mount 21 being the surface of contact.

The mounting means 20 includes a rectilinear visor mount 23 having a rectangular recess 24 and a pair of slots 25 formed therein. The recess 24 is substantially shallow, being formed in an outer half of the visor mount 23. A rectangular portion of an outer wall of the visor mount 23 is removed, forming an opening to the recess 24. The slots 25 are distally spaced and formed into an inner half of the visor mount 23. The positioning of the above elements, i.e., the recess 24, the slots 25, and the opening in the outer wall of the visor mount 23, provides the visor mount 23 with transverse bilateral symmetry.

The visor mount 23 is fixed to a distal end of the visor 12 by means of a channel formed in the inner half of the visor mount 23 and by ultrasonic welding or fastening means such as adhesive or screws.

The mounting means 20 further includes a track link 26 having stabilizing blocks 27 and a peg 28 disposed on an inner end thereof. The tracking feature of the track link 26 is a special hooked outer end thereof which fits over and around the first wall of the shield mount 21, thereby being slideably receivable in the track 22. The longitudinal length of the track link 26 is just slightly less than the width of the opening in the outer wall of the visor mount 23, thereby being securely and slideably receivable therein.

The blocks 27 are integral with and protrude longitudinally from the inner end of the track link 26, and have a width just slightly less than the depth of the recess 24, thereby being securely and slideably receivable therein, providing stabilization and preventing any axial rotation of the track link 26. The peg 28 is cylindrical and integral with the track link 26 in a space between the blocks 27. As with the visor mount 23, the positioning of the above elements, i.e., the blocks 27, the peg 28, and the hooked outer end of the track link 26, provides the track link 26 with transverse bilateral symmetry.

The mounting means 20 still further includes a spring 29 being of the type having straight arms with a 90° bend in ends thereof and a coil of approximately one and a quarter revolutions, i.e., of approximately 450°, at a midpoint thereof, such that as the ends are spread apart, i.e., as to unwind the coil, the spring 20 will provide tension. The coil of the spring 29 is secured on and around the peg 28 with the arms of the spring 29 protruding toward the hooked outer end of the tracking link 26, and with the ends of the spring 29 being inserted into the slots 25, thereby allowing the tracking link 26 transverse movement within the recess 24, as shown by the arrow in FIG. 4. The tension supplied by the spring 29 urges the track link 26 to be fully inserted into the recess 24, and as the track link 26 is drawn out of the recess 24 by an external force, the ends of the spring 29 are allowed longitudinal sliding movement within the slots 25.

After the shield mount 21 and the visor mount 23 are fixed to the shield 11 and the visor 12, respectfully, and after the track link 26 is received by the visor mount 23, i.e., inserted into the recess 24 with the coil of the spring 29 fitted over the peg 28 and the ends of the spring 29 urged and inserted into the slots 25, then the hooked outer end of the track link 26 can be received into the track 22, thereby rendering the visor 12 slideably movable in a longitudinal direction of the shield 11.

This can be accomplished many ways, depending on the preferred embodiment of the shield mount 21, the desired tension of the spring 29, and the length of the slots. As previously mentioned, one preferred embodiment of the shield mount 21 could have the track 22 cut through the entire longitudinal length of the shield mount 21. This would allow the hooked outer end of the track link 26 to be inserted into and received by the track 22, with the first wall of the shield mount 21 received by the hooked outer end of the track link 26, simply by slightly pulling out the track link 26 from recess 24, causing tension in the spring 29, and fitting the hooked outer end of the track link 26 over the first wall of the shield mount 21 and into the track 22 from a top end or a bottom end of the shield mount 21.

Figure 2:
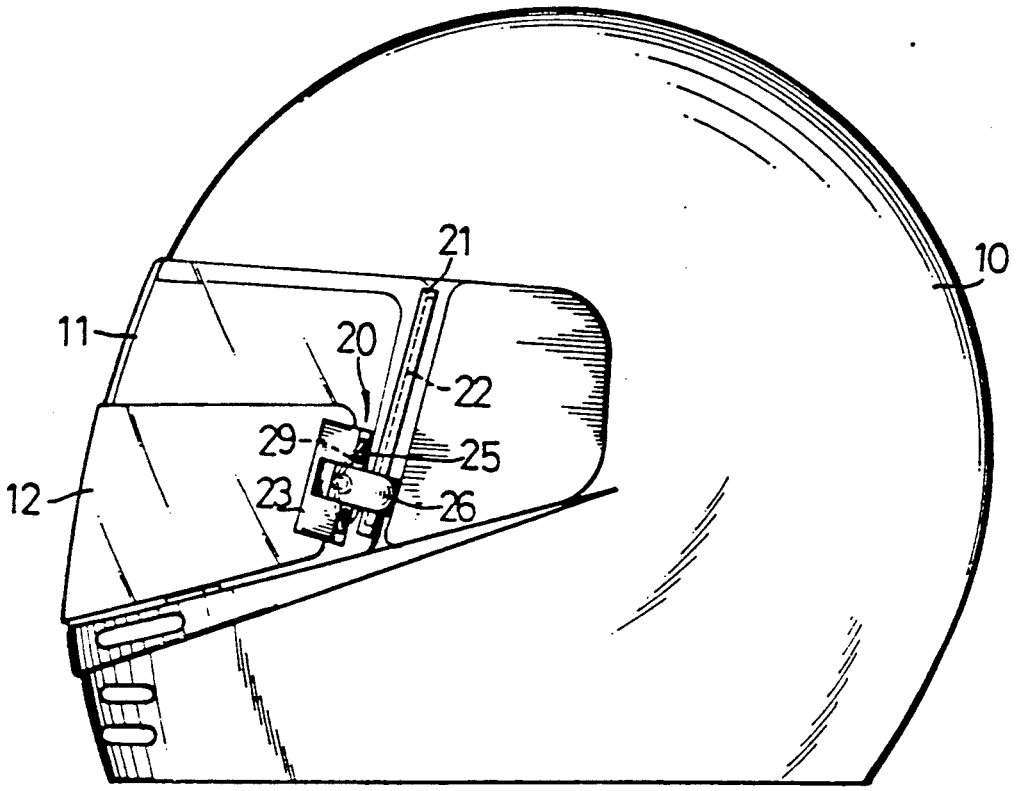
FIG. 2 is a side elevational view of the embodiment illustrated in FIG. 1, showing the auxiliary shielding device in a lowered position.
Figure 3:
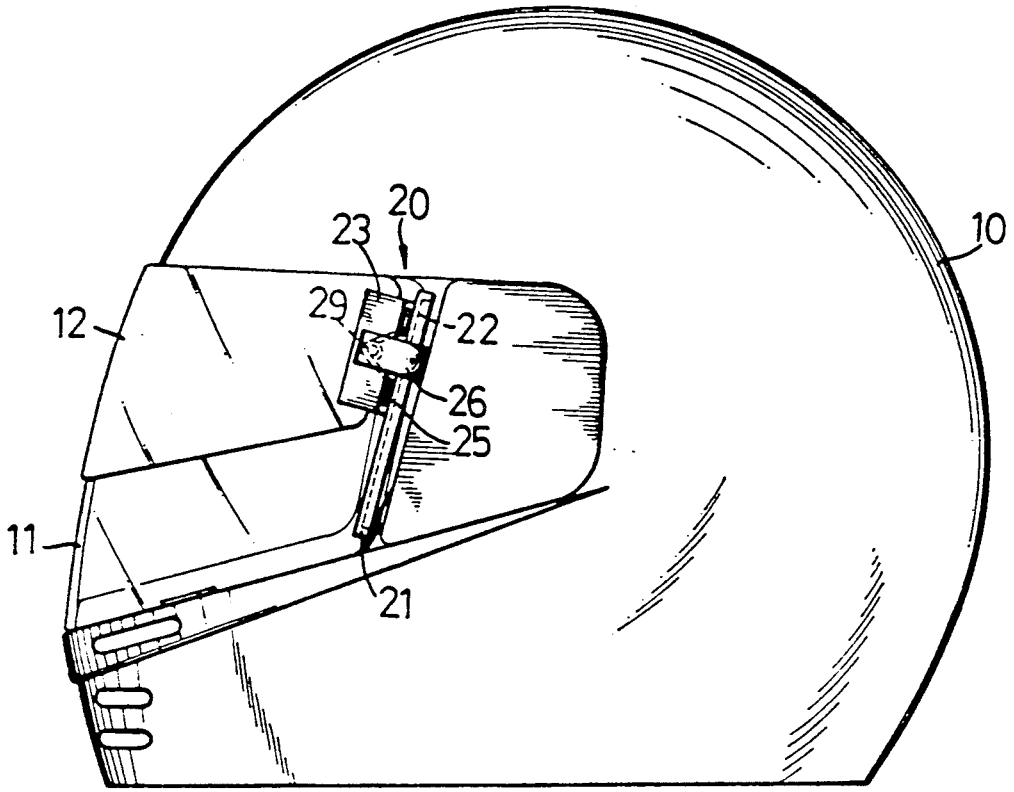
FIG. 3 is a side elevational view of the embodiment illustrated in FIG. 1, showing the auxiliary shielding device in a raised position.

Another possible and preferred embodiment of the shield mount 21 could have the track 22 cut through substantially the entire longitudinal length thereof, thereby leaving the top and bottom ends thereof closed, or in other words, leaving the track 22 as a closed-ended channel, as shown in FIGS. 2 and 3. This embodiment would require the slots 25 to be sufficiently long, allowing the ends of the spring 29 to separate far enough in order that the track link 26 could be pulled out of the recess 24 a sufficient distance to allow the hooked outer end of the track link 26 to fit over and back around onto the first wall of the shield mount 21, thereby being received into the track 22. As also previously mentioned, the second wall of the shield mount 21 could have a beveled inside edge, which would facilitate (as a guiding means) the hooked outer end of the track link 26 being received by the track 22.

Yet another possible and preferred embodiment of the shield mount 21, but not shown in the drawings, could have a plurality of notches formed in the track 22 of in the first wall of the shield mount 21, along the entire longitudinal length of the shield mount 21. The notches could be shaped and formed so that the hooked outer end of the track link could be received therein, allowing the visor 12 to be intervally adjustable and anchorable.

Still another possible and preferred embodiment of the shield mount 21, also not shown in the drawings, is to have the transverse width of the shield mount 21 to be greater at the top end thereof than that at the bottom end thereof, with a smooth gradient therebetween, thereby causing tension of the spring 29 to increase as the track link 26 (and visor 12) is slideably positioned and anchored nearer the top end of the shield mount 21.

It should be known that the coefficients of static and kinetic friction between the contacting surfaces, i.e., the first wall of the shield mount 21, the track 22, and the hooked outer end of the track link 26, depend on the elasticity of the spring 29, i.e., the greater the elasticity of the spring 29, the greater the coefficients of static and kinetic friction, and vise versa.

In reference to the embodiments shown, and previously described, in FIGS. 2 and 3, the visor 12 is shown in two possible situations: (1) shown in FIG. 2, the visor 12 is in a lowered position, allowing the user vision only through the shield 11; and (2) shown in FIG. 3, the visor 12 is in a raised position, allowing the user vision through both the shield 11 and the visor 12, thereby being provided with additional protection for the eyes from the sun. These two situations could be the result of any of the previously described embodiments or any combination thereof.

Additionally as previously mentioned, the transverse bilateral symmetry of the visor mount 23 and track link 26 provides an ease of assembly, allowing either element to be used on either distal end of the visor.

In conclusion, an auxiliary shielding device has been described in relation to preferred embodiments. It is to be understood, however, that even though numerous characteristics, modifications, and advantages of the auxiliary shielding device have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An auxiliary shielding device for a safety helmet with a shield, comprising:

a pair of shield mounts each being fixedly mounted to distal ends of the helmet shield in a longitudinal orientation and having a track formed longitudinally therein;

a visor extending substantially across the helmet shield between said shield mounts; and a pair of engaging means for engaging said visor with said shield mount, each said engaging means comprising a visor mount having a recess in which a distal end of said visor is fixed mounted and a first anchoring means formed therein;

a track link integrally including (a) an outer end being longitudinally slidably engageable in said track of said shield mount; (b) an inner end being transversely slidably receivable in said recess of said visor mount; and (c) a second anchoring means; and a spring means for providing tension being fitted between said visor mount and said track link by means of said first anchoring means and said second anchoring means, respectively, so that said track link is tensionally urged into said recess and that said visor is slidably anchorable across the helmet shield when said outer end of said track link is engaged with said track of said shield mount.

2. The auxiliary shielding device as claimed in claim 1, wherein said visor is transparent and tinted.

3. The auxiliary shielding device as claimed in claim 1, wherein said visor has a longitudinal height approximately one-half of a longitudinal height of the helmet shield.

4. The auxiliary shielding device as claimed in claim 1, wherein said visor is made out of a flexible and pliable material so as to conform to a curvature of the helmet shield.

5. The auxiliary shielding device as claimed in claim 1, wherein each said visor mount has a rectangular portion of an outer wall thereof removed, forming an opening to said recess, so that said track link is slidably receivable within said opening.

6. The auxiliary shielding device as claimed in claim 1, wherein each said outer end of each said track link is hooked so that each said outer end is securely received within each said track of each said shield mount.

7. The auxiliary shielding device as claimed in claim 6, wherein each said inner end of each said track link has a pair of stabilizing blocks extending outward therefrom so that when said track link is received within said opening of said recess of said visor mount, said stabilizing blocks are received in said recess, preventing any axial rotation of said track link.

8. The auxiliary shielding device as claimed in claim 1, wherein:

said first anchoring means for anchoring said spring means to said track link is a protuberance;

said second anchoring means for anchoring said spring means to said visor mount is a pair of longitudinal slots; and said spring means has a pair of straight arms each with a 90° bend in ends thereof and a coil of approximately one and a quarter revolutions (450°) at a midpoint thereof, so that said ends of said spring means are anchorable by said longitudinal slots of said second anchoring means and said coil is anchorable by said protuberance of said first anchoring means.

* * * * *

UNITED STATES PATENT AND TRADEMARK OFFICE

CERTIFICATE OF CORRECTION

PATENT NO. : 5,131,101

DATED : July 21, 1992

INVENTOR(S) : Lee Shu Chin Chen

It is certified that error appears in the above—identified patent and that said Letters Patent is hereby corrected as shown below:

Title page, item [76] should read:

Inventor: Lee Shu Chin Chen

Signed and Sealed this

Thirty-first Day of August, 1993

Bruce Lehman

*Attest:*

BRUCE LEHMAN

*Attesting Officer*

*Commissioner of Patents and Trademarks*